US005669549A

United States Patent [19]

Robertson

[11] Patent Number: 5,669,549

[45] Date of Patent: Sep. 23, 1997

[54] NON-ROUND CONTAINER HAVING AN OFFSET SIDE SEAM

[75] Inventor: Ronald D. Robertson, Kansas City, Mo.

[73] Assignee: Sealright Co. Inc., DeSoto, Kans.

[21] Appl. No.: 517,643

[22] Filed: Aug. 22, 1995

[51] Int. Cl.[6] ..... B65D 3/28

[52] U.S. Cl. ..... 229/4.5; 229/125.05; 229/125.17

[58] Field of Search ..... 229/4.5, 5.5, 5.8, 229/125.05, 125.17

[56] References Cited

U.S. PATENT DOCUMENTS

| | | | |
|---|---|---|---|
| 1,173,284 | 2/1916 | Leiman | 229/4.5 |
| 1,733,674 | 10/1929 | Schleicher | 229/5.5 |
| 2,007,347 | 7/1935 | Rutkowski | 229/5.5 |
| 3,445,049 | 5/1969 | Carpenter, Jr. | 229/4.5 |
| 4,154,360 | 5/1979 | Smith | 229/125.05 |
| 4,632,298 | 12/1986 | Schellenberg | 229/125.17 |
| 4,955,531 | 9/1990 | Graboyes | 229/4.5 |

FOREIGN PATENT DOCUMENTS

| | | | |
|---|---|---|---|
| 4908 | 7/1902 | Denmark | 229/5.5 |
| 668824 | 11/1929 | France | 229/5.5 |
| 372468 | 5/1932 | United Kingdom | 229/5.5 |
| 444725 | 3/1936 | United Kingdom | 229/4.5 |
| 622755 | 5/1949 | United Kingdom | 229/5.5 |

*Primary Examiner*—Gary E. Elkins

*Attorney, Agent, or Firm*—Kokjer, Kircher, Bowman & Johnson

[57] ABSTRACT

A convolute paperboard container comprising a closed bottom, and an upstanding continuous sidewall extending from the bottom and terminating in an upper rim. The container when viewed transversely of its longitudinal axis is curvilinear oblong or oval in shape such that the sidewall comprises broad front and back panels connected by curved side panels of a reduced radius of curvature. A side seam extending vertically from the bottom of the container to its upper rim is positioned along the sidewall in an offset position such that a major portion of the front and back sidewall panels remains uninterrupted by the side seam for purposes of displaying marketing and/or instructional indicia.

15 Claims, 3 Drawing Sheets

NON-ROUND CONTAINER HAVING AN OFFSET SIDE SEAM

BACKGROUND OF THE INVENTION

1. Field of the Invention

The present invention is generally directed to the container and packaging industry, and is more specifically directed to a unique non-round convolute paperboard container having an offset side seam.

2. Description of the Related Art

Various container configurations have been developed over the years for use in storing and dispensing consumer goods. General design objectives in this field include providing a container that is user friendly and well adapted for dispensing the goods in a convenient fashion; a container that is sufficiently durable so as to fully protect the contents during shipment and storage; and a container that is relatively inexpensive with respect to production, storage, disposal and/or recycling. Some containers such as those used for grocery products serve not only as storage receptacles but as product packaging. In those instances, the overall design of the container must also have features that attract the attention of potential purchasers and should be configured to accommodate the display of marketing and instructional indicia.

While containers have been developed in the art which meet some of these objectives, a certain degree of give and take is routine in the art of container design. Thus, a configuration which offers particularly advantageous features for purposes of storage may lack the features deemed most essential to consumer convenience. Take for example, square or rectangular paperboard boxes which are well known in the art and used extensively for packaging grocery items. The box design is advantageous because the boxes can be compactly stacked on display shelves so as to utilize an optimal amount of shelf space. Boxes also provide distinct "billboard" spaces (front, back, and sides) for display of marketing and instructional information. This is a positive feature insofar as those stocking the grocery store shelves can quickly discern the front of the box and position it accordingly for purposes of display.

There are however some disadvantages to the use of a box configuration. For instance, while the distinct front, back and side panels are useful for shelving purposes, they also restrict the type and size of marketing or instructional information that can be provided on the box. Abrupt corner edges are not well suited to a continuous display of graphic marketing materials. Boxes can also be relatively expensive to produce depending upon the size and specific design of the container. Lastly, box containers may be undesirable for storing certain products, particularly within the grocery industry, because of problems with leakage and/or difficulty in dispensing product from the container in a convenient manner.

Round or tubular paperboard canisters such as spiral round or convolute containers have also been successfully used for packaging grocery and other consumer items. Canisters have the advantage of offering a relatively unique design comprising a continuous "billboard" for marketing and instructional information. Lacking extensive folds, slits or notches, these canisters may likewise be less expensive to produce and less susceptible to leakage than some box designs.

Nonetheless, depending upon the type of product being contained, there may be some drawbacks to the use of round canisters as well. For instance, since the containers are circular in shape, stockers may fail to present the "front" of the canister on the display shelf which could negatively impact overall sales. The round canisters also generally take up more shelf space than their square counterparts, meaning that less product is actually stocked on the shelves at any given time. Another drawback in the case of storing dry granular or liquid products is that the wide rounded mouth of a circular canister is not conducive to dispensing the product out of the container by pouring.

While these and other prior art designs clearly have utility for purposes of packaging a variety of goods, there remains a need in the industry for new and improved container configurations which serve the dual role of storage receptacle and product packaging.

SUMMARY OF THE INVENTION

It is therefore an object of the present invention to provide a convolute paperboard container for containing dry, semi-dry and liquid products that is relatively inexpensive to produce and easy to use and store.

It is another object of the present invention to provide a convolute paperboard container that is non-circular in shape having a front and a back panel for ease in display of marketing and instructional indicia.

A related object of the present invention is to provide a convolute paperboard container having a front and back panel that is easily distinguishable for purposes of shelving and display.

Still a further object of the present invention is to provide convolute paperboard containers that can be stacked one against another in rows to take advantage of an optimal amount of the shelf space available for display and storage.

Yet another object of the present invention is to provide a convolute paperboard container having a large continuous surface area for the display of marketing and instructional indicia.

Another object of the present invention is to provide a convolute paperboard container with an offset side seam such that marketing and instructional indicia may be displayed on the front and back of the container without the interruption of a seam.

Another object of the present invention is to provide a convolute paperboard container that enables the product contained therein to be readily poured from the container in a controlled fashion.

These and other objects are achieved by a container having a closed bottom, and an upstanding continuous sidewall extending from the bottom and terminating in an upper rim. The container when viewed transversely of its longitudinal axis has a curvilinear and oblong or oval shape. This particular shape is advantageous in that it provides a container having relatively broad front and back sidewall panels connected by curved side panels. The broad front and back panels make the container well suited for storage and display, while the curvilinear shape enables a continuous display of marketing indicia beyond the front or back panels of the container. The graphics simply gradually disappear from view along the receding curved side panels.

The sidewall is preferably formed of a single sheet or blank of paperboard wrapped about the longitudinal axis of the container with the side edges of the paperboard blank being brought together and affixed in overlapping relation to form a side seam. The side seam extends vertically from the bottom of the container to the upper rim. The side seam is positioned along the sidewall in an offset position such that a major portion of the front and back sidewall panels remains uninterrupted for purposes of displaying marketing or instructional indicia. In a preferred embodiment, the side seam is provided within the curved side panels of the container so as to enhance the overall billboard space provided by the container.

BRIEF DESCRIPTION OF THE DRAWINGS

These and other objects and features of the present invention are explained in more detail with reference to the drawings, in which like reference numerals denote like elements, and in which.

DETAILED DESCRIPTION OF THE INVENTION

Figure 1:
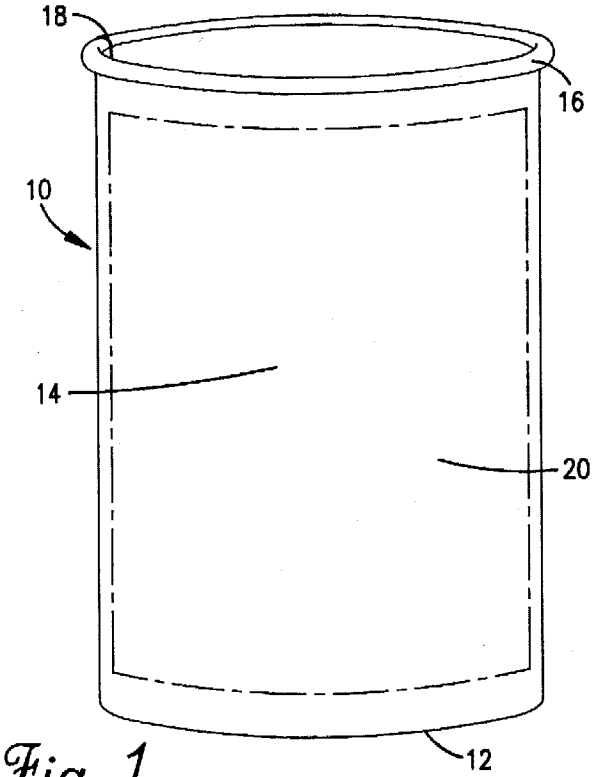
FIG. 1 is a perspective view of the front of a container in accordance with the present invention.
Figure 2:
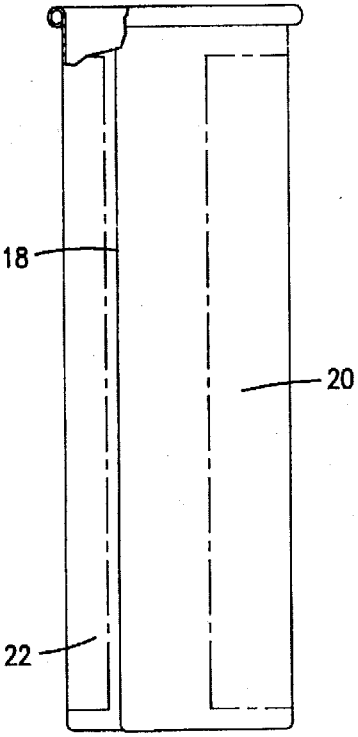
FIG. 2 is a side plan view in partial cross-section of the container in FIG. 1.
Figure 3:
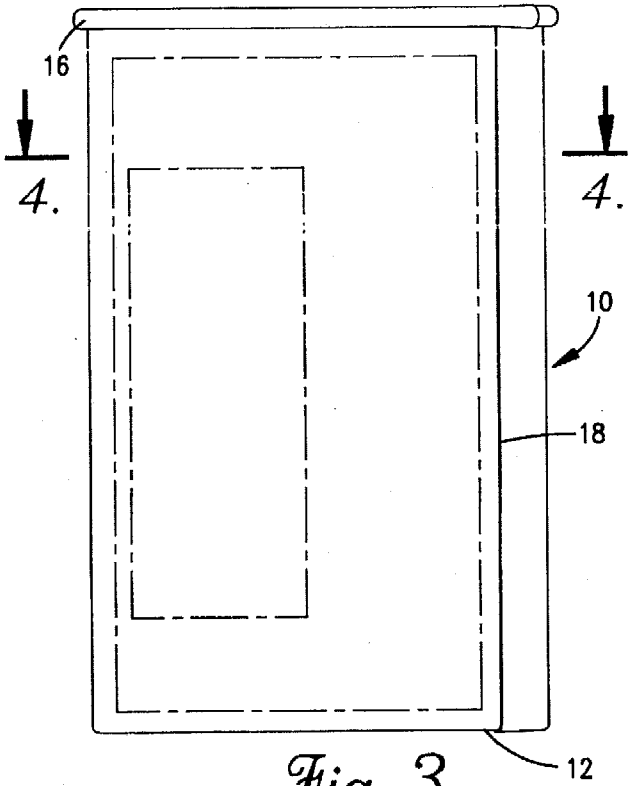
FIG. 3 is a back plan view of the container in FIG. 1.

Referring now to the drawings in more detail, a container in accordance with a preferred embodiment of the present invention is generally designated by the reference numeral 10. Container 10 is a convolute paperboard container comprising a closed flat bottom 12, and an upstanding continuous sidewall 14 which is wrapped about the longitudinal axis of the container and affixed to bottom 12. Sidewall 14 extends vertically upward from the outer periphery of bottom 12 and terminates in an outwardly rolled upper rim 16. The sidewall and bottom together form a cavity for receiving and storing dry, semi-dry and/or liquid products. The cavity is accessible through an open top which is bounded by upper rim 16.

Figure 4:
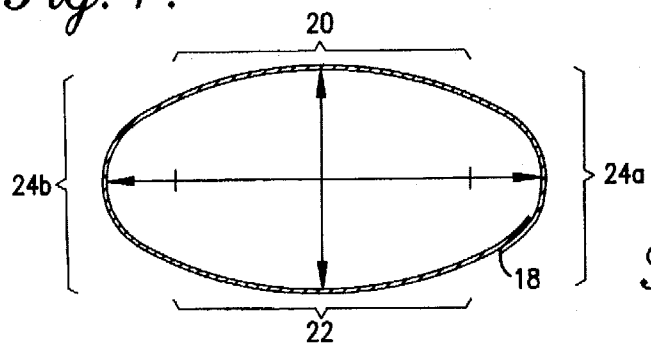
FIG. 4 is a sectional view taken along line 4—4 of FIG. 3 in the direction of the arrows.

Best shown with reference to FIGS. 1 and 4, upstanding sidewall 14 forms a curvilinear and oblong or oval shaped perimeter about the container when viewed transversely of its longitudinal axis. This perimeter is more specifically defined by a major axis a that is of greater length than minor axis b. The outer periphery of closed bottom 12 correspondingly has an oval shape generally of the same dimensions as those of the oval perimeter formed by sidewall 14. The curvilinear oblong shape of the sidewall results in a container having relatively broad front and back panels 20 and 22 respectively. These panels are slightly curved in nature but are generally aligned with major axis a. Front and back panels 20 and 22 are connected by curved side panels **24*a* and 24*b***. The curved side panels have a smaller radius of curvature than the broad front and back panels.

The container is preferably made as a "convolute" paperboard container meaning that the upstanding sidewall 14 is formed from a single sheet or blank of paperboard wrapped about the longitudinal axis of the container with the side edges of the blank being brought together and affixed in overlapping relation to form a side seam 18. The paperboard blank is generally in the form of a square or rectangular sheet of paperboard having top, bottom and side edges. The blank is wrapped about the longitudinal axis of the container such that the top edge of the paperboard blank forms upper rim 16 and the bottom edge of the paperboard blank is secured to bottom 12. The bottom edge of the paperboard is secured to bottom 12 using any means known in the art including adhesives and heat sealing means.

Figure 5:
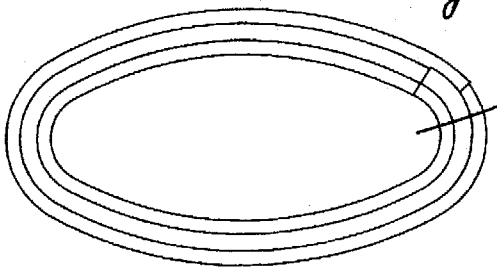
FIG. 5 is a bottom plan view of the container in FIG. 1.

As illustrated in FIG. 5, the closed bottom 12 is formed of a flat oval sheet of paperboard. The bottom edge of the paperboard blank is folded under and around the periphery of bottom 12 and secured to the lower face of the bottom. To eliminate bulkiness, slits may first be cut along the bottom edge of the paperboard to more easily shape the board around the curvilinear periphery of the bottom. Of course, it should be understood that any other means now known or hereafter developed in the art for joining a closed bottom with a convolute paperboard sidewall would be deemed suitable for purposes of this invention.

The side edges of the paperboard blank forming the sidewall are brought together and secured in overlapping relation to form a side seam 18 extending vertically from bottom 12 to upper rim 16. The side edges may be secured together to form the side seam using any means known in the art including adhesives and heat sealing means. The side seam is provided in an "offset" position along the sidewall as hereafter described so as to enhance the quality of "billboard" space provided by the container sidewall for marketing and/or instructional indicia. To this end, the side seam is positioned outside the main viewing perspective of one examining the front or back of the container such that a major portion of the front and back sidewall panels 20 and 22 respectively remains uninterrupted by the side seam. Preferably, the side seam is positioned outside of the front and back panels altogether and is instead positioned within the confines of one of the curved side panels **24*a* or 24*b***.

In a preferred embodiment of the invention as shown in FIG. 4, each curved side panel 24 may be divided into front and back portions at the intersection of major axis a with the sidewall. In this embodiment, side seam 18 is positioned adjacent the intersection of major axis a and the sidewall within the back portion of a curved side panel 24. Most preferably, the side seam is presented within the back portion of a curved side panel at an angle of about 30° to 70°, and preferably about 45°, from the intersection of major axis a and sidewall 14, such angle being measured from the center of the radius of curvature of the curved side panel. This particular embodiment is advantageous insofar as it facilitates a continuous display of marketing or instructional indicia on the front panel of the container—the display gradually disappearing from view along the curved sides without any interruption of a side seam. When viewed from the back of the container, the side seam is offset within the receding curved side panel leaving the broad back panel also free of the distraction of a side seam.

Figure 8:
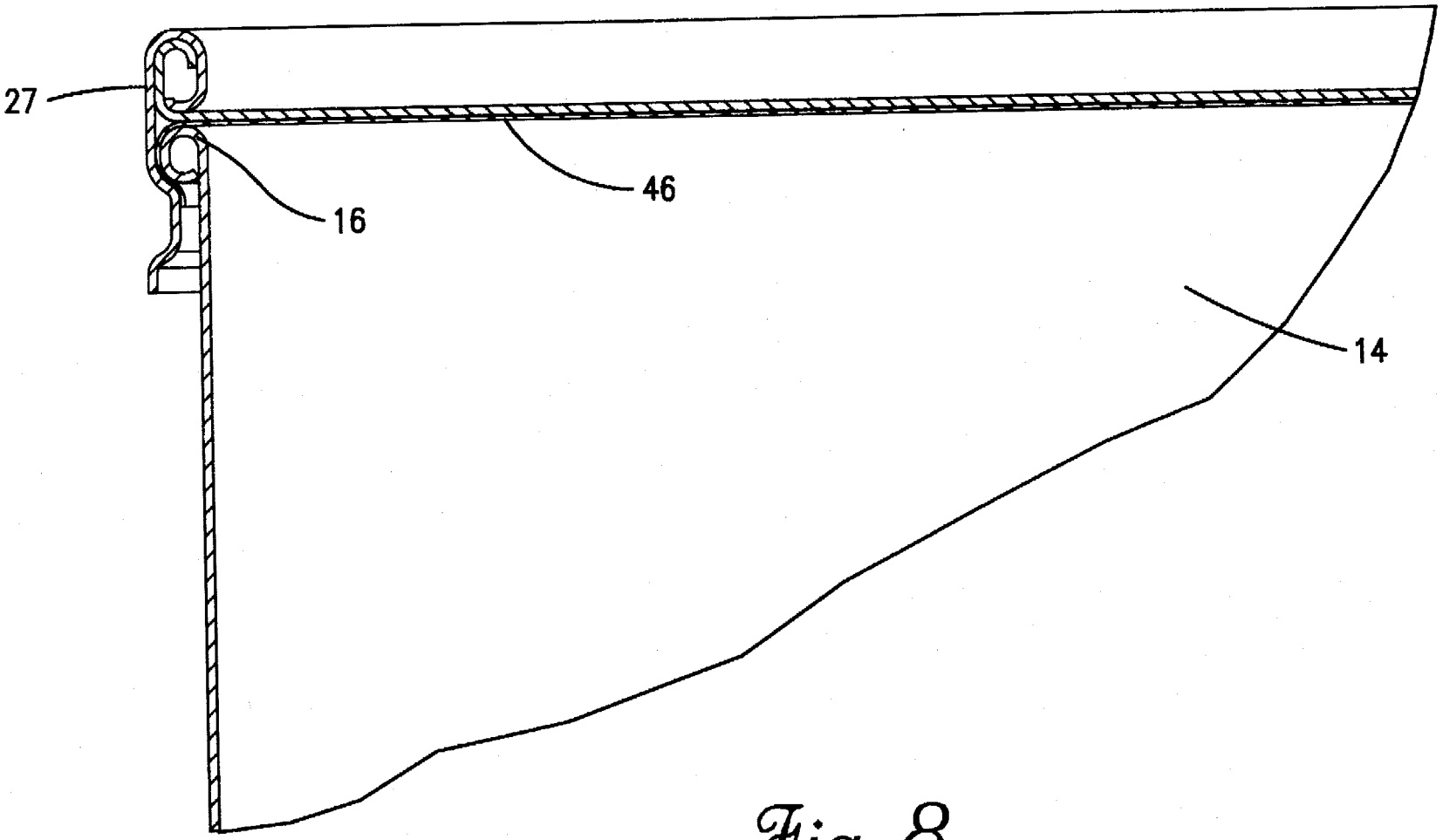
FIG. 8 is an enlarged fragmentary detail displaying in partial cross section the back plan view of a container in accordance with an alternative embodiment of the present invention wherein the container includes a tamper evident membrane and a reusable lid.

While not shown in FIGS. 1–5, the container will typically include a closure lid which is adapted to releasably engage upper rim 16 and/or an upper portion of sidewall 14. Various lid configurations are known in the art including disposable lids such as spiral or ring-pull lids, and reusable lids such as those secured to the upper rim by an interference lock. Such a reusable closure lid 27 adapted for repeated closure of the open top is shown in FIG. 8. Any removable lid constructed to securely close the open top of the container is deemed suitable for purposes of this invention.

Figure 6:
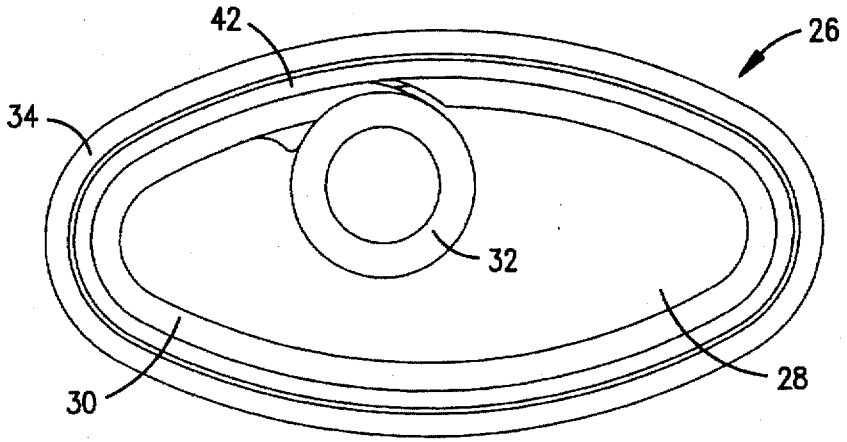
FIG. 6 is a top plan view of a second embodiment of the invention showing a ring-pull disposable lid over the open top of the container.
Figure 7:
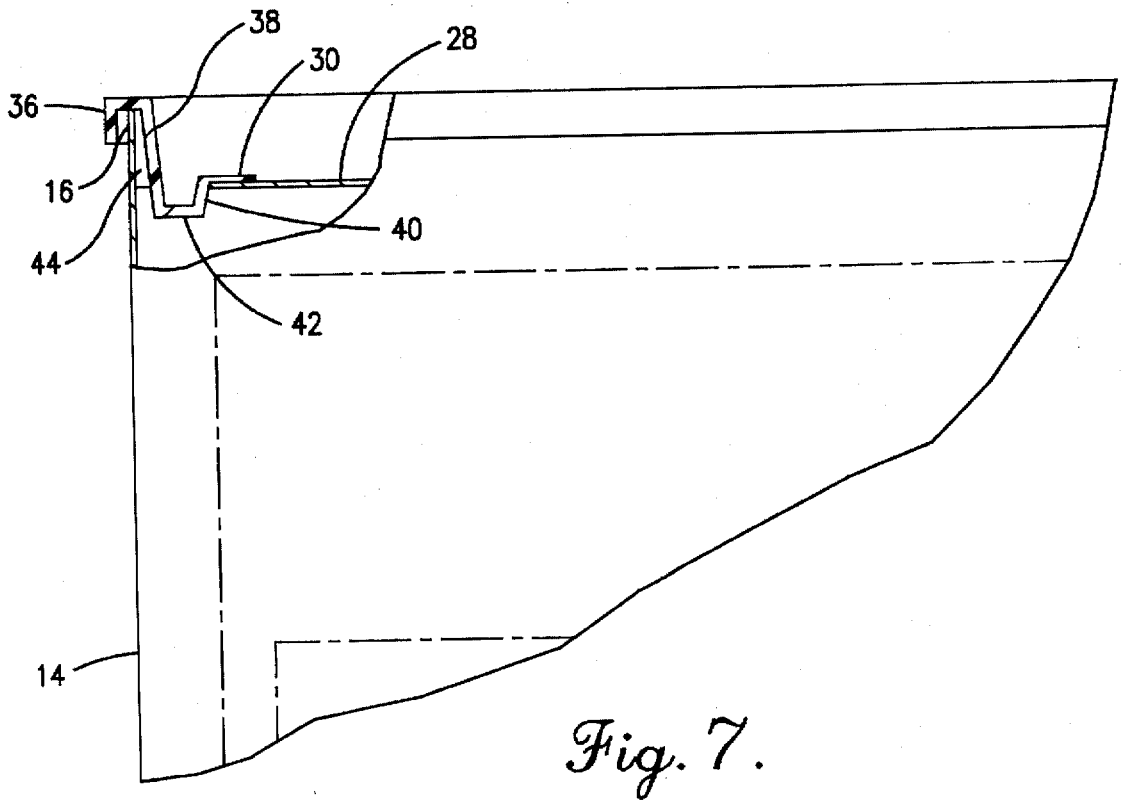
FIG. 7 is an enlarged fragmentary detail displaying in partial cross-section the back plan view of the container and lid in FIG. 6.

In one embodiment of the invention, a disposable ring-pull lid is provided as a removable closure for the container. This particular embodiment is shown in FIGS. 6 and 7 of the drawings. The removable lid 26 comprises a generally flat or planar lid body 28 large enough to span the open top of the container. The lid body 28 is made of relatively thin paperboard or like material that is easily torn for removal of the lid. A ring pull strip 30 connected at one end to a flat ring member 32 is adhered as a frame along the upper peripheral face of lid body 28. To open the container, ring member 32 may be pulled upwardly and outwardly along the periphery of lid body 28, detaching pull strip 30 and the underlying periphery of lid body 28 from the remainder of the lid body. To this end, pull strip 30 and ring member 32 are preferably made of a pliable plastic or laminate material that will enhance convenient removal of the lid.

Pull strip 30 is made integral with a rim attachment 34 so as to connect the lid body 28 to upper rim 16 for secure closure of the container. Rim attachment 34 comprises an outer downwardly extending lid wall 36 configured to correspond generally in shape to the outer face of container sidewall 14, and an inner downwardly extending lid wall 38 configured to correspond generally in shape to the inner face of the container sidewall. Together, the lid walls 36 and 38 respectively form a recess which complimentally receives upper rim 16 and a portion of sidewall 14. In this particular embodiment, upper rim 16 comprises a straight upstanding edge of the sidewall and does not comprise an outwardly rolled rim as in the embodiment of FIGS. 1–5. Of course it is envisioned that rim attachment 34 could be configured to fit over a rolled rim in accordance with the present invention.

A peripheral shoulder 40 extending downwardly from pull strip 30 is coupled with inner lid wall 38 via a peripheral flange 42 extending from the bottom of inner lid wall 38 to the bottom of the shoulder. Protruding ribs 44 may be provided along the interior surface (the surface adjacent the container sidewall) of lid walls 36 and 38 for tightly engaging the sidewall.

Upon filling the container with the desired amount of product, lid 26 may be secured to the container by securing rim attachment 34 to the upper rim and container sidewall by any method known in the art including adhesives or pressure bonding.

To further enhance security and to provide an indication of whether or not the container has been tampered with or damaged during transport or storage, a tamper evident sealing membrane 46 as shown in FIG. 8 may optionally be applied to the container at its upper rim prior to attachment of a closure lid. The membrane 46 may be formed of a flexible material such as foil, paper, plastic, or laminate. The membrane 46 will have a size and peripheral configuration similar to that of the open top of the container such that the membrane 46 may be secured to the inner or outer face of the container sidewall along the upper rim. The membrane 46 may be secured by any method known in the art including adhesives, ultrasonic or thermal bonding, or cold pressure bonding.

In a preferred embodiment of the invention, the material used to form the container sidewall, bottom and lid body, optionally includes a paperboard stock core having inner and outer faces coated with a barrier material. Such materials are typically formed of heat sealable plastic and well known in the prior art. The barrier layers serve to provide moisture and/or gas barriers such that the contents of the container do not degrade the structural integrity of the paper. These barriers also serve to prevent contamination of the contents stored within the container.

From the foregoing it will be seen that this invention is one well adapted to attain all ends and objects hereinabove set forth together with the other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative, and not in a limiting sense.

What is claimed:

1. A container for storing and packaging dry, semi-dry or liquid goods, said container having a longitudinal axis and comprising:

a closed bottom;

an upstanding sidewall wrapped about said longitudinal axis of the container and extending from the closed bottom to form a storage cavity, wherein said sidewall forms a curvilinear and oblong perimeter about the container storage cavity when viewed transversely of the longitudinal axis of said container, said perimeter being defined by a major axis a of greater length than a minor axis b and said sidewall comprising a broad front panel connected to a broad back panel by curved side panels, wherein each of said curved side panels has a smaller radius of curvature than said broad front and back panels; and an offset side seam extending longitudinally along said upstanding sidewall such that said side seam is positioned within one of said curved side panels remote from a line of intersection between said major axis a and said sidewall.

2. A container in accordance with claim 1, wherein said container is formed of paperboard.

3. A container in accordance with claim 1, wherein said sidewall and closed bottom together form a cavity accessible through an open top bounded by an upper rim.

4. A container in accordance with claim 3, wherein said container includes a closure lid adapted to releasably close said open top.

5. A container in accordance to claim 4, wherein said closure lid comprises a reusable lid which is adapted for repeated closure of said open top.

6. A container in accordance to claim 4, wherein said closure lid comprises a disposable ring pull lid.

7. A container in accordance with claim 3, wherein said container additionally comprises a tamper evident sealing membrane applied to the container along said upper rim.

8. A container in accordance with claim 7, wherein said tamper evident/sealing membrane is formed of a flexible material selected from the group consisting of foil, paper, plastic, or laminate.

9. A container in accordance with claim 2, wherein said paperboard is coated with a barrier material.

10. A container in accordance with claim 9, wherein said barrier material is selected from the group consisting of a heat sealable plastic material.

11. A container in accordance with claim 1, wherein said offset side seam is positioned within one of said curved side panels at an angle ranging from 30° to 70° from the line of intersection of major axis a and said sidewall, said angle being measured from a center of the radius of curvature of the curved side panel.

12. A container in accordance with claim 11, wherein said offset side seam is positioned within one of said curved side panels at an angle of about 45° from the line of intersection of major axis a and said sidewall.

13. A container for storing and packaging dry, semi-dry or liquid goods, said container having a longitudinal axis and comprising:

a closed bottom having an outer periphery that is curvilinear in shape;

an upstanding sidewall extending upward from the outer periphery of said closed bottom and terminating in an upper rim such that the sidewall and closed bottom together define a cavity accessible through an open top bounded by said upper rim, the sidewall being formed from a sheet of paperboard wrapped about the longitudinal axis of said container, said sheet of paperboard including side edges that are secured together in overlapping relation to form a side seam extending from said closed bottom to said upper rim, the container when viewed transverse of said longitudinal axis forms a perimeter around the cavity that is curvilinear and oblong in shape, said perimeter being defined by a major axis a having a greater length than a minor axis b and said sidewall comprising a broad front panel connected to a broad back panel by curved side panels wherein the curved side panels have a radius of curvature that is less than the radius of curvature of the broad front and back panels, and wherein the side seam is in an offset position along said sidewall such that the side seam extends within one of said curved side panels remote from a line of intersection between the major axis a and the sidewall.

14. A container in accordance with claim 13, wherein said offset side seam is positioned within one of said curved side panels at an angle ranging from 30° to 70° from the line of intersection of major axis a and said sidewall, said angle being measured from a center of the radius of curvature of the curved side panel.

15. A container in accordance with claim 14, wherein said offset side seam is positioned within one of said curved side panels at an angle of about 45° from the intersection of major axis a and said sidewall.

* * * * *